United States Patent [19]

Aldefeld

[11] Patent Number: 5,071,267

[45] Date of Patent: Dec. 10, 1991

[54] ACTUATION MAGNET FOR A PRINTING STYLUS OF A MATRIX PRINTER

[75] Inventor: Bernd E. H. Aldefeld, Hamburg, Fed. Rep. of Germany

[73] Assignee: U.S. Philips Corporation, New York, N.Y.

[21] Appl. No.: 651,059

[22] Filed: Feb. 1, 1991

Related U.S. Application Data

[63] Continuation of Ser. No. 86,004, Aug. 14, 1987, abandoned.

[30] Foreign Application Priority Data

Aug. 14, 1986 [DE] Fed. Rep. of Germany ..... 3627648

[51] Int. Cl.[5] ..... B41J 2/27

[52] U.S. Cl. ..... 400/124; 400/157.2

[58] Field of Search ..... 400/124, 157.2; 101/93.04, 93.05; 335/229, 230, 236, 255

[56] References Cited

U.S. PATENT DOCUMENTS

| | | | |
|---|---|---|---|
| 3,755,700 | 8/1973 | Buschmann | 400/124 X |
| 4,044,878 | 8/1977 | Kunath | 400/124 |
| 4,226,545 | 10/1980 | Brandenburg | 400/124 |
| 4,259,653 | 3/1981 | McGonigal | 400/124 X |
| 4,479,103 | 10/1984 | Bailey | 335/229 |

FOREIGN PATENT DOCUMENTS

| | | | |
|---|---|---|---|
| 18352 | 10/1980 | European Pat. Off. | 400/157.2 |
| 1481297 | 7/1977 | United Kingdom | 400/124 |

*Primary Examiner*—David A. Wiecking
*Assistant Examiner*—John S. Hilten

[57] ABSTRACT

The invention relates to an actuation magnet for a printing stylus (11) of a matrix printer, in which an armature (12) of the plunger type connected to the printing stylus (11) is guided in the cylindrical inner space of two soft-magnetic pole pieces (6,7) enclosed by a direct current energizing coil (14), the space between these pole sleeves (6,7) being bridged by a spacer element (17), which consists of a material, whose magnetic conductance or permeance is considerably smaller than that of the material of the pole sleeves (6,7). The movement force exerted on the soft-magnetic armature (12) is increased in that the distance between the ends of a yoke (13) is bridged by a permanent magnet (17), whose pole faces engage the free ends of the yoke (13), and in that the energization of the energizing coil (14) produces a magnetic flux, which has a sense opposite to a magnetic flux of the permanent magnet (17) through the yoke (13).

6 Claims, 1 Drawing Sheet

ACTUATION MAGNET FOR A PRINTING STYLUS OF A MATRIX PRINTER

This is a continuation of application Ser. No. 086,004, filed Aug. 14, 1987, now abandoned.

The invention relates to an actuation magnet for a printing stylus of a matrix printer, in which an armature of the plunger type connected to the printing stylus is guided within two cylindrical soft-magnetic pole sleeves enclosed by a direct current energizing coil, a space between said pole sleeves being bridged by a spacer element, which consists of a material, whose magnetic conductance or permeance is considerably lower than that of the material of the pole sleeves.

Such an arrangement is described in German Patent Application publication 2509917 which corresponds to British Patent 1481297.

The invention has for its object to increase the moving force exerted on the printing stylus.

Either higher attractive forces should be attainable at given values of the magnet volume and of the energizing power, or conversely the magnet volume and/or the energizing power should be reduced at given attractive forces.

This object is achieved in that the spacer element is an annular permanent magnet and in that a magnetic flux produced by energization of the energizing coil has a sense opposite to a magnetic flux of the permanent magnet through a yoke.

The permanent magnet ensures that the ratio between the magnetic flux density Bj in the soft-magnetic return yoke and the flux density B determining the attractive force at the area of the air gap to the soft-magnetic armature is reduced.

With unchanged yoke dimensions, the saturation of the soft-magnetic material is then smaller so that the required air gap flux can be attained with a smaller energization through the energizing coil. Conversely, larger air gap inductances and hence larger attractive forces are obtained if the energization through the energizing coil is maintained.

Of course the condition to obtain this effect is that the flux density in the yoke at the operating area is so large that the soft-magnetic material of the yoke is utilized in a range of its characteristic magnetic curve, in which the permeability decreases with increasing flux density (saturation effect), in which event high inductances and low permeabilities would occur without the use of permanent magnets. However, this condition is always satisfied on behalf of a full utilization of the material because the nominal inductances in soft-magnetic materials are always chosen to be considerably larger than 0.5 T (Tesla).

Especially if the space between the ends of the yoke is small and/or if a high flux density should be attained, it is to be preferred to use permanent magnets consisting of materials from the group of rare earth metals, more particularly samarium-cobalt magnets. Such magnets have a high energy density (product of coercive force and remanent inductance) as well as a small reversible permeability. Such magnets act substantially as air for the flux produced by the electrical energization.

The most satisfactory operation is obtained if the pole faces of the permanent magnet immediately engages the free ends of the yoke, but an advantageous effect in accordance with the invention is obtained also at not excessively large distances.

For the actuation of the printing styli of a matrix printer, according to the invention particularly small and fully utilized armatures of the plunger type are obtained, which with small dimensions permit great forces and rapid stylus movements.

In order that the invention may be readily carried out, it will now be described more fully, by way of example, with reference to the accompanying drawing, in which.

Figure 1:
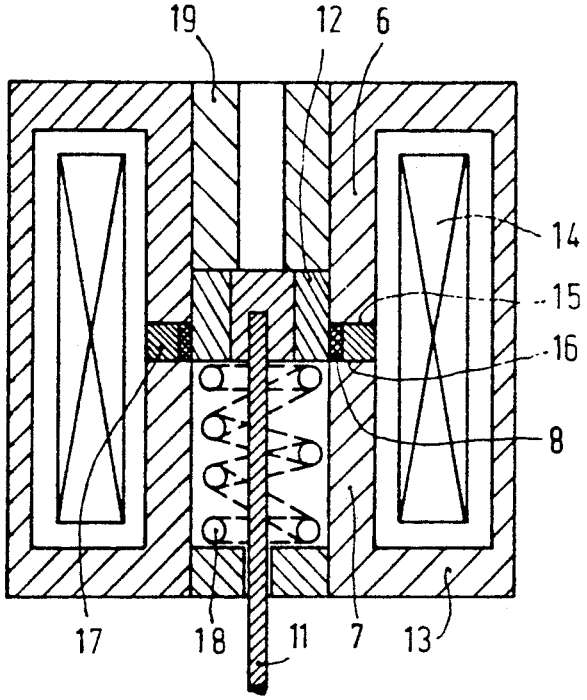
FIG. 1 shows diagrammatically a preferred embodiment of the invention.

In the embodiment shown in FIG. 1, an attractive force is exerted on a soft-magnetic armature 12 by pole sleeves 6 and 7 connected to a U-shaped soft-magnetic yoke 13 if an energizing coil 14 is energized by direct current. According to the invention, the space between the pole sleeves 6 and 7 is bridged by an annular permanent magnet 17. This magnet produces a magnetic flux essentially only through the yoke 13 because the magnetic resistance or reluctance Rj thereof is considerably smaller than that of the path through the armature 12.

In order that the permanent magnet 17 does not substantially cause any holding force in the attracted state of the armature 12, measures can be taken in known manner to maintain a minimum air gap, obtained, for example, by thin non-magnetic layers.

The flux produced by the energization of the energizing coil 14 flows essentially only through the armature 12 because the magnetic resistance Rδ through this path is considerably smaller than the magnetic resistance Rm of the path through the permanent magnet 17, whose reversible permeability is very small when using ceramic magnets, more particularly magnets of rare earth metals. The magnetic flux produced by the energizing coil 14 in the yoke 13 has a sense opposite to that of the flux produced by the permanent magnet 17.

Figure 2:
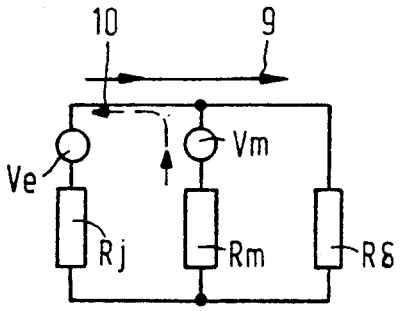
FIG. 2 shows a simplified magnetic equivalent circuit diagram of an embodiment as shown in FIG. 1.

FIG. 2 shows a simplified magnetic equivalent circuit diagram, in which Ve represents the electrical energization of the energizing coil 14 and Vm represents the coercive force or the permanent magnetic energization. The magnetic resistance Rδ, especially at low energizing currents through the energizing coil 14, is of the order of a multiple of the value Rj. Rm is again many times larger than Rδ, so that it can be assumed on approximation that the electrically produced flux indicated by a full arrow 9 flows only through an armature 12 and the permanent magnet flux indicated by a broken arrow 10 flows only through the yoke 13. The magnetic flux through the armature 12 and hence the effect of the force then depend on first approximation only upon the electrically produced flux, while the flux density in the yoke is proportional to the difference between the electrical and the permanent magnetic flux and hence comparatively small so that a smaller energizing power is required to produce the given flux through the armature 12 because the state of saturation of the yoke 13 is reduced.

The physical principle, to change the magnetic flux density in the yoke of an electrically energized direct current magnet by means of a permanent magnet, is known from European Patent Application publication 0018352 which corresponds to U.S. Pat. No. 4,479,103.

The armature construction of the plunger type shown in FIG. 1 serves to actuate the printing stylus 11 of a matrix printer, which is fixedly secured to the armature 12 of the plunger type. When the energizing coil 14 is energized with direct current, the armature 12 of the plunger type and hence the printing stylus 11 is moved downwards against the force of the spring 18. The Figure indicates the starting position, in which the armature 12 of the plunger type is pressed by the spring 18 against an abutment stop 19.

For the arrangement shown in FIG. 1, characteristic data were determined without and with the use of a permanent magnet 17. The comparison values of the following tables were then obtained:

| | without permanent magnet | with permanent magnet |
|---|---|---|
| maximum force on the armature | 3.03 N | 3.86 N |
| track time for 0.5 mm path | 0.37 ms | 0.33 ms |
| Mechanical energy after 0.5 mm path | 0.79 mJ | 1.05 mJ |
| eddy current losses | 0.81 mJ | 0.90 mJ. |

Figure 3:
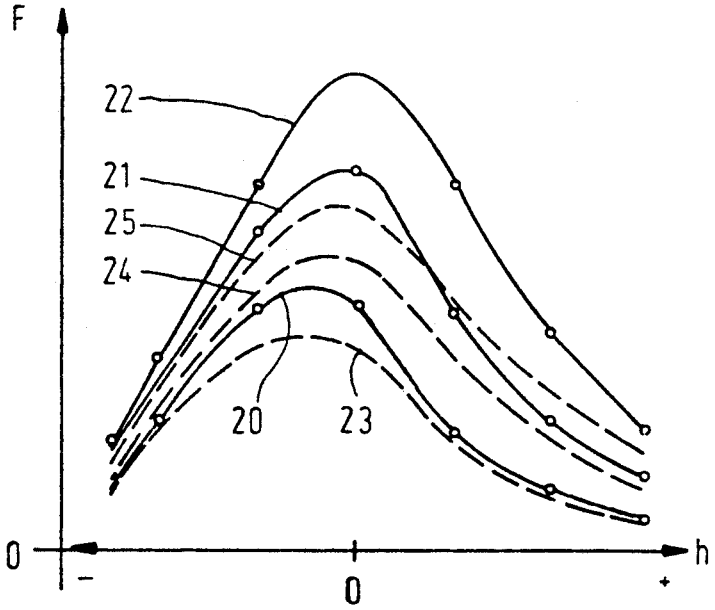
FIG. 3 shows characteristic curves through the armature path determined for an embodiment as shown in FIG. 1.

FIG. 3 shows associated characteristic curves of the force F exerted on the armature 12 of the plunger type in the direction of the printing stylus 11 as a function of the armature position h in the range of about +0.5 mm. The abscissa value h=0 defines the starting position that can be seen in FIG. 3. A negative sweep means in FIG. 3 the direction of downward movement.

The full curves 20, 21 and 22 were determined with a permanent magnet, whereas the broken curves 23, 24 and 25 were determined without a permanent magnet. The characteristic curves 20 and 23, 21 and 24 and 22 and 25 comparable with each other were measured at different energizing currents.

The advantageous effect of the invention appears unambiguously from the above table and from FIG. 3.

The invention may serve to obtain one or more of the following effects: Higher values for magnetic force;

mechanical energy;

electromechanical efficiency;

maximum repetition frequency of the movement of the armature;

Lower values for heating;

weight;

dimensions.

In the arrangement shown in FIG. 1, for example, the annular cross-section of the permanent magnet 17 could be larger or also smaller than the adjacent annular surfaces 15 and/or 16 of the pole sleeves 6 and 7, respectively.

Preferably, as shown in FIG. 1, the space between the pole sleeves 6 and 7 is filled only at the radially external area by the annular permanent magnet 17, while a layer 8 of a non-magnetic material, whose workability corresponds to that of the soft-magnetic material of the pole sleeves 6 and 7, is provided coaxially within the permanent magnet 17 with respect to the cylindrical sliding surface of the armature 12. An austenite steel is particularly suitable for the layer 8. The internal nachining of the pole sleeves 6 and 7 can take place continuously without a discontinuity obtained due to the hard material of the permanent magnets 17 having a disturbing effect.

What is claimed is:

1. An actuation magnet for a printing stylus of a matrix printer including an armature of the plunger type connected to said printing stylus, two cylindrical soft magnetic poles sleeves, a direct current energizing coil around said pole sleeves, a space between said pole sleeves, a spacer element in said space, said spacer element comprising a material with a permeance which is considerably lower than that of the material of he pole sleeves, said spacer element being an annular permanent magnet and energizing means energizing said coil to produce a magnetic flux of opposite direction to the magnetic flux of the permanent magnet, said permanent magnet having arranged coaxially within it an annular layer of a non-magnetic material.

2. An arrangement as claimed in claim 1, wherein the material of the permanent magnet (17) consists of elements from the group of rare earth metals.

3. An arrangement as claimed in claim 2 wherein an annular layer (8) of a non-magnetic material, is arranged coaxially within the permanent magnet (1).

4. An arrangement as claimed in claim 2, wherein the permanent magnet (17) consists of samarium-cobalt.

5. An arrangement as claimed in claim 4 wherein an annular layer (8) of a non-magnetic material, is arranged coaxially within the permanent magnet (17).

6. An arrangement as claimed in claim 1, characterized in that the layer (8) consists of austenite steel.

* * * * *